US007213785B2

(12) United States Patent
Richert et al.

(10) Patent No.: US 7,213,785 B2
(45) Date of Patent: May 8, 2007

(54) METHOD AND DEVICE FOR TURNING STRIPS

(75) Inventors: Withold Richert, Hückelhoven (DE); Rolf Bünten, Aachen (DE)

(73) Assignee: SMS Demag AG, Düsseldorf (DE)

( * ) Notice: Subject to any disclaimer, the term of this patent is extended or adjusted under 35 U.S.C. 154(b) by 221 days.

(21) Appl. No.: 10/480,755

(22) PCT Filed: May 31, 2002

(86) PCT No.: PCT/EP02/06007

§ 371 (c)(1),
(2), (4) Date: Dec. 11, 2003

(87) PCT Pub. No.: WO02/100749

PCT Pub. Date: Dec. 19, 2002

(65) Prior Publication Data

US 2004/0149856 A1 Aug. 5, 2004

(30) Foreign Application Priority Data

Jun. 13, 2001 (DE) ..... 101 28 576

(51) Int. Cl.
*B65H 23/32* (2006.01)

(52) U.S. Cl. ..... 242/615.2; 242/615.21

(58) Field of Classification Search ..... 242/615.2, 242/615.21, 548, 548.3, 566; 226/189, 190, 226/196.1

See application file for complete search history.

(56) References Cited

U.S. PATENT DOCUMENTS 1,273,926 A * 7/1918 Roesen ..... 101/420
2,177,727 A * 10/1939 Krakaur ..... 118/43
2,212,006 A * 8/1940 Buchanan ..... 198/839
2,261,359 A * 11/1941 Gautier ..... 242/615.2

(Continued)

FOREIGN PATENT DOCUMENTS

DE 1090621 10/1958
DE 3827864 2/1990

OTHER PUBLICATIONS

Patent Abstracts of Japan, vol. 1998, No. 01, Jan. 30, 1998 & JP 09 227000 A (Kawasaki Steel Corp), Sep. 2, 1997.
Patent Abstracts of Japn, vol. 2002, No. 02, Apr. 2, 2002 & JP 2001 302049 A (Nippon Steel Corp), Oct. 31, 2001.

*Primary Examiner*—William A. Rivera
*Assistant Examiner*—Scott Haugland
(74) *Attorney, Agent, or Firm*—Friedrich Kueffner

(57) ABSTRACT

The invention relates to a method for turning and reorienting the displacement direction of strips (1), especially of a thin hot strip. The strip can be turned about any angle by means of at least one deflection roller, with roller banks (5) which are arranged on the circumference of the deflection roller, and which respectively comprise a plurality of individual rollers. Plastic and elastic deformations are avoided due to the fact that the strip is supported at various points by the individual rollers of successive roller banks (5). The invention also relates to a device for carrying out the method. Said device enables the roller banks placed one after the other in the strip deflection direction to be staggered in relation to each other in such a way that the contact surfaces of their rollers with the strip are staggered from bank to bank, by one roller width (11,12).

2 Claims, 3 Drawing Sheets

U.S. PATENT DOCUMENTS 3,583,621 A 6/1971 Bryant
4,227,636 A * 10/1980 Rahmfeld et al. ..... 226/189
4,343,422 A * 8/1982 Dabringhaus et al. ..... 226/170
4,687,125 A * 8/1987 Hashimoto et al. ..... 226/21
5,540,423 A * 7/1996 Nakano ..... 271/10.12

* cited by examiner

METHOD AND DEVICE FOR TURNING STRIPS

The invention concerns a device for turning and reorienting the running direction of strips, especially thin hot strip, in which the strip can be turned about any angle by at least one deflection roller by means of roller banks, which are arranged on the circumference of the deflection roller, such that the strip is supported at different points by the individual rollers of successive roller banks, and such that the roller banks successively arranged in the strip turning direction are staggered relative to each other in such a way that the contact surfaces of their rollers with the strip are staggered from roller bank by one roller width.

A strip deflection device for turning metal strips is already known, in which a rotatable drum is oriented with its axis inclined to the running direction of the strip that is running in, and the strip follows a helical path, which advances at an angle of twist relative to the circumferential arc, along an arc of contact.

Several guide pieces are arranged on the surface of the drum side by side in the circumferential direction and in such a way that they can be moved in the axial direction of the drum, so that the strip can be deflected by the desired angle according to the angle of twist and the arc of contact (DE 25 40 714).

A further development is described in DE 38 27 864 C2. In this design, the individual rollers are supported in roller strips and are detachably mounted on the surface of the deflecting cylinder in such a way that they are parallel and staggered relative to one another and form a helical deflecting surface.

The disadvantage of these previously known devices for turning and reorienting strips is that their arrangements of the rollers or roller banks cause plastic and elastic deformations in the strips with decreasing strip thicknesses.

The strip to be turned has contact with the rollers of all of the roller banks in the same place. This causes off-flatness, especially when small strip thicknesses are involved.

Another disadvantage is that the rollers leave an impression in the strip with decreasing strip thickness. The distance between two adjacent rollers on a roller bank in accordance with the previous designs is permanently predetermined by the bearing width and the angle of inclination of the rollers to the axis of the drum. Therefore, it is not possible to alter the distance between the individual rollers.

The objective of the invention is to specify a method that prevents plastic and elastic deformations, which occur especially during the turning and reorienting of thin strips. A further objective of the invention is the development of a device for carrying out this method.

In this regard, the invention is based on the idea that the first roller of the second roller bank, as viewed in the direction in which the strip is running, is arranged in the region of the strip that lies between the first and second rollers of the first roller bank.

Since the strip is supported over its entire length in the course of the strip deflection by the rollers of each successive roller bank, which are staggered relative to the rollers of the preceding roller bank, there is significant reduction of deformation and considerable improvement of flatness. The strip can no longer be pulled between two adjacent rollers of a roller bank, which is a disadvantage of the previous designs that causes problems especially in the region near the edge of the strip.

The invention also concerns a device that is especially well suited for carrying out the claimed method and that has at least two roller banks with at least two rollers each.

The invention is explained in greater detail below on the basis of a specific embodiment.

Figure 1:
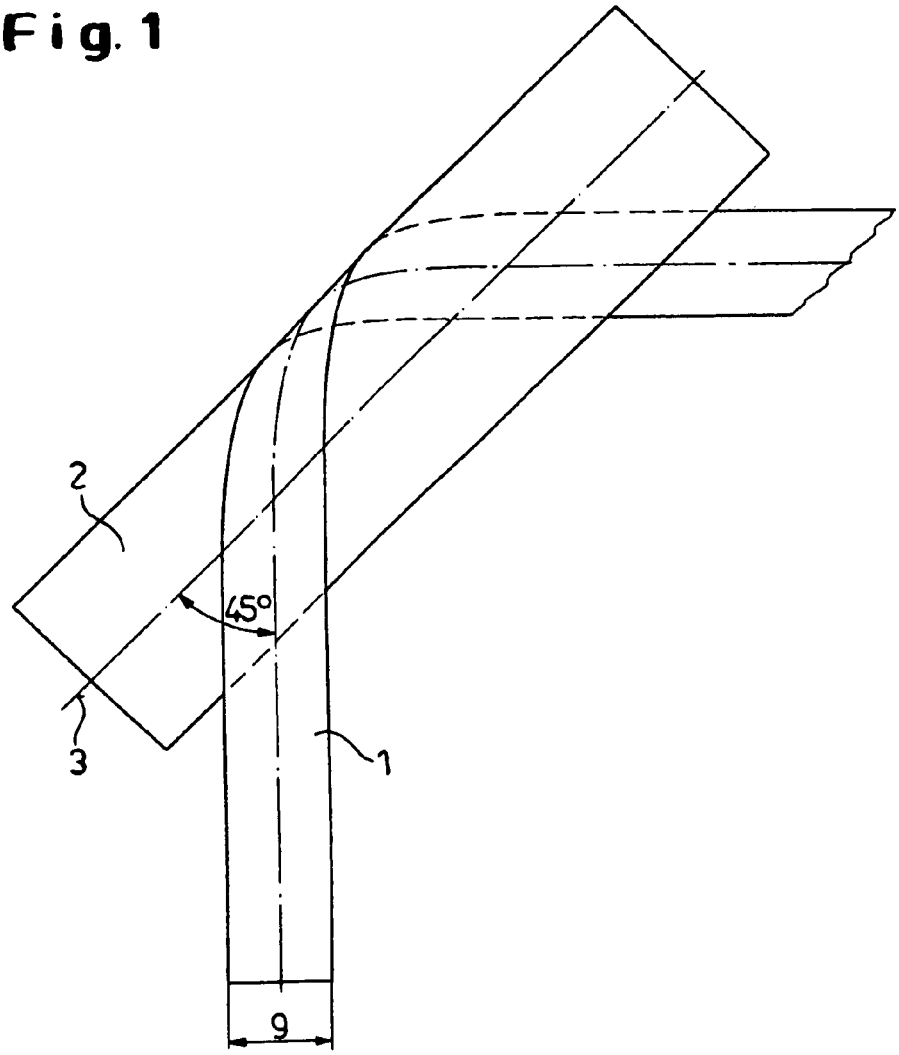
FIG. 1 shows a deflection roller as a single unit with a strip running in and running out.

As shown in FIG. 1, a strip 1 is run in at an angle of 45° to the longitudinal axis 3 of the deflection roller 2 and run back out, also at an angle of 45°, to achieve a deflection of 90°.

In this design, the strip 1 winds around the deflection roller 2 over half of its circumference.

The rollers 4 are arranged in banks 5 and are distributed over the region of the deflection roller 2 that the strip 1 winds around.

Figure 2:
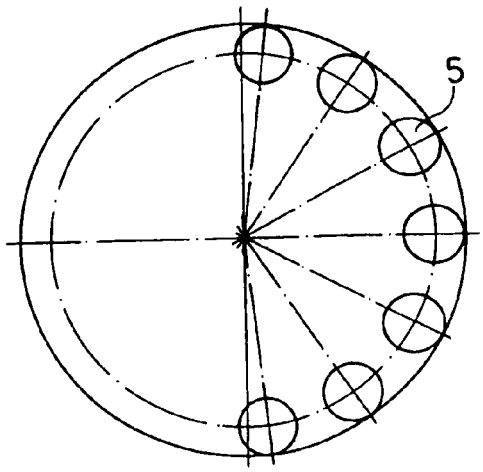
FIG. 2 shows the deflection roller of FIG. 1 as viewed towards an end face.

FIG. 2 shows an arrangement of seven roller banks 5, which are arranged with uniform angular separation along half the circumference of the deflection roller 2.

For a deflection of 90°, the individual rollers 4 on a roller bank 5 are aligned at 45°.

Figure 3:
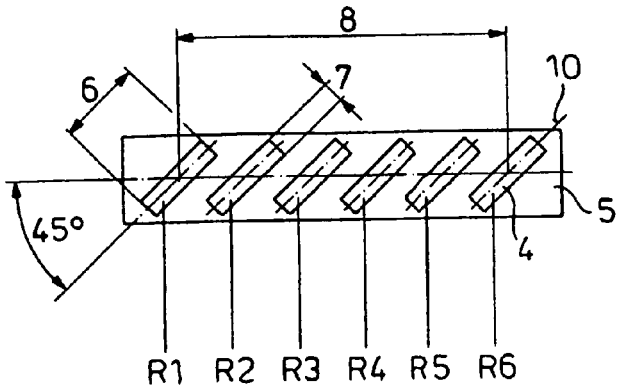
FIG. 3 shows a top view of a roller bank as a single unit of the deflection roller of FIG. 2.

In accordance with FIG. 3, the strip 1 is supported by six rollers 4 (R1 to R6). These six rollers 4 (R1 to R6) have the same diameter 6 and the same width 7.

The distance 8 between the center width of the first roller R1 and the center width of the sixth roller R6 is the same as the width 9 of the strip. The right and left edges of the strip 1 thus lie on the center axis 10 of the rollers R1 and R6 and are supported.

Figure 4:
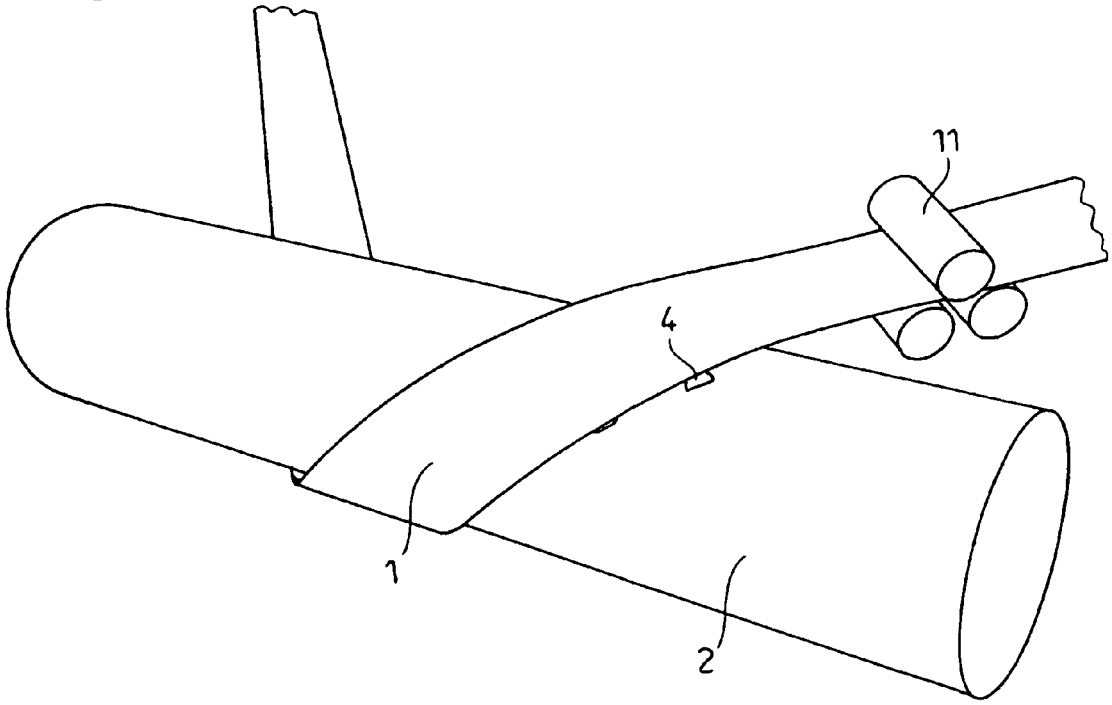
FIG. 4 shows a perspective view of the deflection roller of FIG. 1 with an additionally installed steering roller stand.

In FIG. 4, a steering roller stand 11 is additionally installed. It establishes a uniform tension on the strip 1. The drawing also shows how the edge of the strip 1 is supported by the roller 4, only half of which is concealed by the strip 1.

Figure 5:
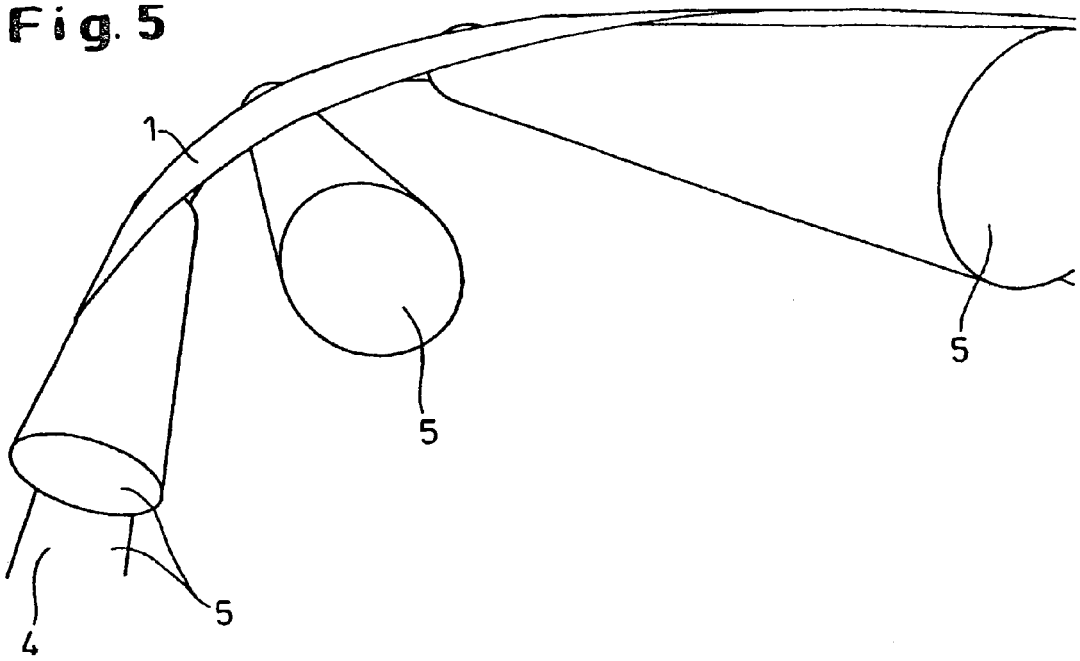
FIG. 5 shows the polygonization of the strip around the individual rollers of the successive roller banks in a perspective view.

FIG. 5 shows the strip 1 as it is being uniformly supported by the individual rollers 4 of the roller banks 5.

Figure 6:
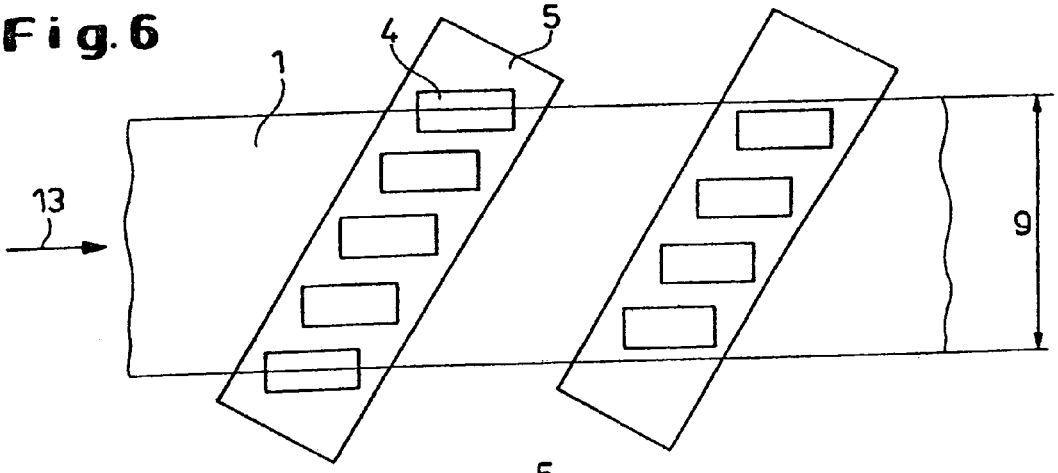
FIG. 6 shows an arrangement with two successive roller banks of the deflection roller of FIG. 2.

FIG. 6 shows an arrangement with two roller banks 5 of the deflection roller of FIG. 2. In the running direction 13 of the strip 1, the contact of the strip with the rollers 4 of roller bank 5 is staggered by the width of a roller 4 from the first roller bank 5 to the next roller bank 5.

Figure 7:
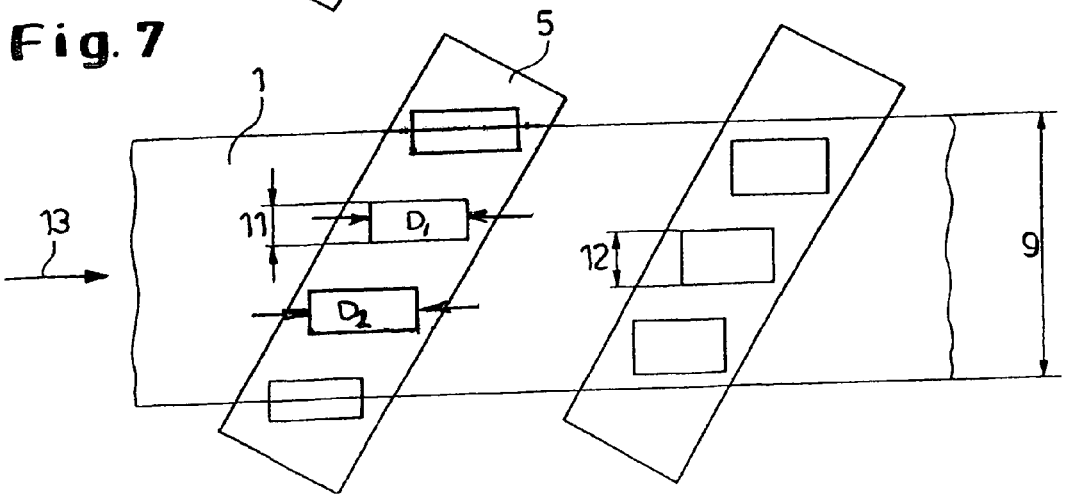
FIG. 7 shows a view as in FIG. 6, but with wider rollers than in FIG. 6.

However, it is also possible, as shown in FIG. 7, to design the individual rollers of a roller bank 5 with a width 11 that is different from the width 12 of the individual rollers 4 of the adjacent roller bank 5.

Staggered contact between the strip and the rollers can also be achieved by the installation of rollers with slightly varied diameters, as shown in FIG. 7. For clarity the difference in diameter is exaggerated in the drawing.

The impressions and off-flatness that occur with the previously known devices, especially in the case of thin hot strip, are avoided by the measures described above.

The invention claimed is:

1. Device for turning and reorienting the running direction of thin hot metal strip, comprising at least one deflection roller (2) and roller banks (5) which are arranged on the circumference of the deflection roller, wherein the strip (1) can be turned about any angle by the at least one deflection roller (2) by means of the roller banks (5), and in which the strip is supported at different points by the individual rollers of successive roller banks (5), such that the roller banks (5) successively arranged in the strip turning direction are staggered relative to each other in such a way that the contact surfaces of their rollers (4 or R1 to R6) with the strip (1) are staggered from roller bank to roller bank by a width of one roller of the immediately preceding roller bank, wherein the width (7) of the individual rollers (4 or R1 to R6) is different from roller bank (5) to roller bank.

2. Device in accordance with claim 1, wherein the diameters of the individual rollers (4 or R1 to R6) of a roller bank (5) are different.

* * * * *